US011428517B2

(12) United States Patent
Agazim et al.

(10) Patent No.: US 11,428,517 B2
(45) Date of Patent: Aug. 30, 2022

(54) PROJECTILE WITH INSERT

(71) Applicant: NPEE L.C., Hialeah, FL (US)

(72) Inventors: Erik Agazim, Hialeah, FL (US); Arnold Iacoviello, Jr., Hialeah, FL (US); Milton V. Barnes, University City, MO (US)

( * ) Notice: Subject to any disclaimer, the term of this patent is extended or adjusted under 35 U.S.C. 154(b) by 0 days.

(21) Appl. No.: 17/025,610

(22) Filed: Sep. 18, 2020

(65) Prior Publication Data

US 2021/0180927 A1 Jun. 17, 2021

Related U.S. Application Data

(60) Provisional application No. 62/903,031, filed on Sep. 20, 2019.

(51) Int. Cl.
*F42B 12/34* (2006.01)

(52) U.S. Cl.
CPC ..... *F42B 12/34* (2013.01)

(58) Field of Classification Search
CPC ..... F42B 12/34; F42B 12/24
USPC ..... 102/501–510
See application file for complete search history.

(56) References Cited

U.S. PATENT DOCUMENTS

| | | | | | |
|---|---|---|---|---|---|
| 594,199 | A * | 11/1897 | Field | F42B 12/34 | 102/507 |
| 843,017 | A | 2/1907 | Hoxie | | |
| 854,923 | A * | 5/1907 | Broad | F42B 12/34 | 102/508 |
| 1,493,614 | A | 5/1924 | Dickerman | | |
| 1,556,160 | A | 10/1925 | Riggs | | |
| 2,409,307 | A | 10/1946 | Patch | | |
| 4,245,557 | A * | 1/1981 | Knappworst | F42B 12/34 | 102/508 |
| 4,776,279 | A * | 10/1988 | Pejsa | F42B 12/34 | 102/510 |
| 4,958,572 | A | 11/1990 | Martel | | |
| 5,198,616 | A | 3/1993 | Anderson | | |
| 5,641,937 | A | 6/1997 | Carter | | |
| 6,074,454 | A | 6/2000 | Abrams | | |
| 6,186,071 | B1 | 2/2001 | Fry | | |

(Continued)

FOREIGN PATENT DOCUMENTS

| | | |
|---|---|---|
| DE | 2641021 | 3/1978 |
| DE | 10042719 | 3/2001 |

(Continued)

OTHER PUBLICATIONS

PCT/US2017/061587 International Search Report, dated Feb. 5, 2018.

*Primary Examiner* — Reginald S Tillman, Jr.
(74) *Attorney, Agent, or Firm* — Wolter VanDyke Davis, PLLC; Robert L. Wolter

(57) ABSTRACT

A bullet (10) including: body (11) with a base (12), a distal end (13) with a mouth (14), and an interior cavity (34) recessed into the body from the mouth; an insert (40) configured to be held in the interior cavity and to protrude from the mouth; and at least one skive (50) formed in the distal end and axially overlapping the interior cavity relative to a center axis (16) of the body. The interior cavity is configured to permit limited axial recession of the insert into the interior cavity when the insert impacts a hard target. The limited axial recession opens a pocket (80) between the insert and the mouth.

28 Claims, 8 Drawing Sheets

(56) References Cited

U.S. PATENT DOCUMENTS

| | | | | |
|---|---|---|---|---|
| 6,263,798 | B1 | 7/2001 | Benini | |
| 6,536,352 | B1 | 3/2003 | Nadkarni | |
| 6,772,695 | B2 | 8/2004 | Kellner | |
| 6,776,818 | B1 | 8/2004 | Nilsson | |
| 6,971,315 | B2 | 12/2005 | Knappworst | |
| 7,299,750 | B2 | 11/2007 | Schikora | |
| 7,360,491 | B2 | 4/2008 | Sanborn | |
| 7,380,502 | B2 | 6/2008 | Emary | |
| 8,186,277 | B1 | 5/2012 | King | |
| 8,393,273 | B2 | 3/2013 | Weeks | |
| 9,003,974 | B2 | 4/2015 | Muskal | |
| 9,316,468 | B2 | 4/2016 | Rall | |
| 9,341,455 | B2 | 5/2016 | Fricke | |
| 10,119,797 | B2 | 11/2018 | Burczynski | |
| 2004/0003747 | A1 | 1/2004 | Hietanen | |
| 2006/0124022 | A1 | 6/2006 | Eberhart | |
| 2007/0028793 | A1* | 2/2007 | Sauvestre | F42B 12/34 102/508 |
| 2008/0264290 | A1 | 10/2008 | Salvel | |
| 2009/0308275 | A1 | 12/2009 | Nilsson | |
| 2012/0216700 | A1 | 8/2012 | Dennison | |
| 2012/0111220 | A1 | 10/2012 | King | |
| 2014/0318406 | A1* | 10/2014 | Rall | F42B 33/001 102/510 |
| 2015/0308800 | A1 | 10/2015 | Schnabel | |
| 2016/0047638 | A1 | 2/2016 | Gallaher | |
| 2016/0097619 | A1 | 4/2016 | Emary | |
| 2016/0169645 | A1 | 6/2016 | Emary | |
| 2016/0223307 | A1 | 8/2016 | Bray | |
| 2017/0205215 | A1 | 7/2017 | Sloff | |
| 2017/0219325 | A1 | 8/2017 | Smith | |
| 2017/0248396 | A1 | 8/2017 | Riess | |
| 2017/0336186 | A1 | 11/2017 | Smith | |

FOREIGN PATENT DOCUMENTS

| | | | | |
|---|---|---|---|---|
| DE | 102014224715 | B4 * | 7/2019 | F42B 12/34 |
| WO | 2015118173 | | 8/2015 | |

* cited by examiner

View A-A

View C-C

View B-B

PROJECTILE WITH INSERT

BACKGROUND

Ammunition is available in a wide variety of types and sizes that correspond to a large array of uses. Law enforcement, such as police officers, SWAT teams, and federal agents, often seek ammunition with particular characteristics. For example, lead free ammunition is popular among law enforcement, since lead can be toxic after long term exposure. Also, frangible ammunition is typically used by law enforcement since it exhibits controlled penetration into targets, and is less likely to cause injury or damage to persons and objects distant from the point of bullet impact.

Recently, there has been a renewed interest among law enforcement and hunters into ammunition which provides for controlled penetration capacity. Law enforcement desire higher penetration capacity ammunition in situations where a perpetrator may possess body armor but where the penetration into the soft target is still a controlled penetration. Hunters desire higher penetration capacity ammunition in situations where certain game, such as wild boar, may have a tough exterior layer of skin or hair but penetration into the soft target after piercing the exterior layer of the skin is controlled.

One solution to these problems is the use of well-known armor piercing bullets that typically comprise a penetrator of a hardened metal designed to carry the maximum possible amount of energy as deeply as possible into the target. The problem with said armor piercing bullets is two-fold. First, armor piercing bullets do not exhibit controlled penetration into targets, and in fact are designed to travel as far into a target as possible. This can result in said bullet travelling through a target and causing injury or damage to persons and objects distant from the point of bullet impact. Second, armor piercing bullets are subject to more stringent federal laws that restrict the use and sale of said ammunition. Thus, it is not desirable to utilize ammunition that has been designated as armor piercing, due to said legal restrictions.

Consequently, a need exists to overcome the problems with the prior art, and more particularly for ammunition that meets all of the needs of law enforcement and hunters where controlling penetration into a soft target is desired, regardless of whether a barrier exists between a firearm and the soft target.

SUMMARY

Embodiments relate to a projectile accelerated from a device, such as a bullet from a firearm where penetration into a soft target is controlled, regardless of any barrier in front of soft target. An aspect of the embodiment includes a bullet comprising: body comprising a base end, a distal end comprising a mouth, and an interior cavity recessed into the body from the mouth; an insert configured to be held in the interior cavity and to protrude from the mouth; and at least one skive formed in the distal end and axially overlapping the interior cavity relative to a center axis of the body. The interior cavity is configured to permit limited axial recession of the insert into the interior cavity when the insert impacts a hard target, and wherein the limited axial recession opens a pocket between the insert and the mouth.

Another embodiment includes: a body comprising a base end, a distal end comprising a mouth, and an interior cavity that is recessed into the body from the mouth and that defines a support feature; an insert configured to be held in the interior cavity and to protrude from the mouth; and a plurality of skives: formed in the distal end; axially overlapping the interior cavity relative to a center axis of the body; and forming a plurality of petals, each petal of the plurality of petals formed between respective circumferentially adjacent skives of the plurality of skives and between the interior cavity and an outer surface of the bullet. The support feature is also formed in a radially inner surface of the plurality of petals and is configured to permit limited axial recession of the insert into the interior cavity when the insert impacts a hard target. The limited axial recession opens a pocket between the insert and the mouth and also initiates a radially outward expansion of the support feature and thereby the plurality of petals in which the support feature is formed.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered limiting of its scope, the embodiments will be described and explained with additional specificity and detail through the use of the accompanying drawings in which.

DETAILED DESCRIPTION

Figure 1:
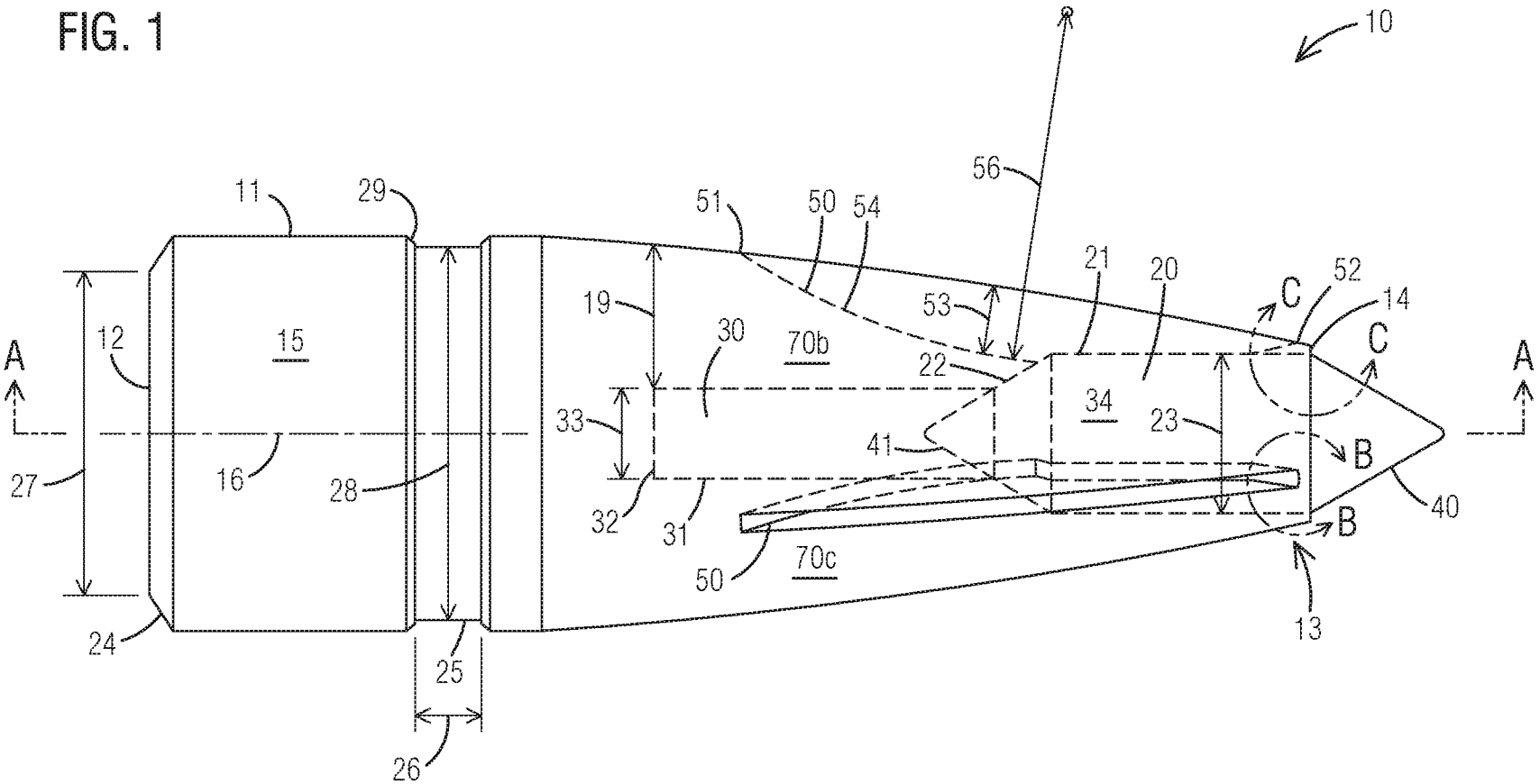
FIG. 1 is a side view of a bullet according to an embodiment disclosed herein.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

FIG. 1 is a side view of a bullet 10 according to an embodiment disclosed herein. The bullet 10 includes a body 11 with a base 12 and a distal end 13. The distal end 13 may further include a mouth 14 that connects to a primary cavity 20 that may be formed within the body 11. The bullet 10 has a chamfer 24 that may be radii or conical, creating a diameter 27 of the base 12 that is smaller than the diameter of body 11, which is known in the prior art. Additionally, the bullet 10 may have a groove 25 having a second diameter 28 smaller than that of the body 11 and a width 26 also known to those skilled in the art as a "crimp groove." The groove 25 may have a chamfer 29 lead in and lead out, but may also be a radii, conical, or straight wall groove with no chamfer 29. In an embodiment, a secondary cavity 30 may be formed within the body 11. The secondary cavity 30 may be interiorly communicated with the primary cavity 20. The bullet 10 may also include an outer surface 15 and center axis 16.

In an embodiment, the primary cavity 20 may have a primary contour 21, a support feature 22, and a primary diameter 23. In a non-limiting embodiment, the primary contour 21 and the support feature 22 may be at least one of a square shape, a conical shape, a tubular shape, or a combination thereof. For instance, in the non-limiting example of FIG. 1, the primary cavity 20 has a tubular shaped primary contour 21 extending from the mouth 14 into the body 11 and the support feature 22 has a conical shape.

In another embodiment, the secondary cavity 30 may have a secondary contour 31, a floor 32 and a secondary diameter 33. In some non-limiting embodiments, the secondary contour 31 and the floor 32 may be at least one of a square shape, a conical shape, a tubular shape, or a combination thereof. Referring again to the non-limiting example of FIG. 1, the secondary cavity 30 is interiorly communicated with the primary cavity 20. It may be noted that the secondary contour 31 may be contiguous with the support feature 22. In FIG. 1, the floor 32 is shown as a square shape perpendicular to the center axis 16. However, in other embodiments, the floor 32 may be conical or round as previously mentioned. In an embodiment, the primary cavity 20, the support feature 22, and the secondary cavity 30 constitute an interior cavity 34 that is recessed into the body 11 from the mouth 14. In an embodiment, the interior cavity 34 is the entirety of that which is recessed into the body 11 from the mouth 14.

In another embodiment, the center axis 16 may bisect at least one of the primary diameter 23 and the secondary diameter 33. In yet another embodiment, at least one of the primary cavity 20 and the secondary cavity 30 may be concentric with at least one of each other or the center axis 16. In another embodiment, the secondary cavity 30 may be smaller than the primary cavity 20 in at least one of volume, length, and major diameter. In yet another embodiment, the primary cavity 20 may be smaller than the secondary cavity 30 in at least one of volume, length, and major diameter.

Figure 2:
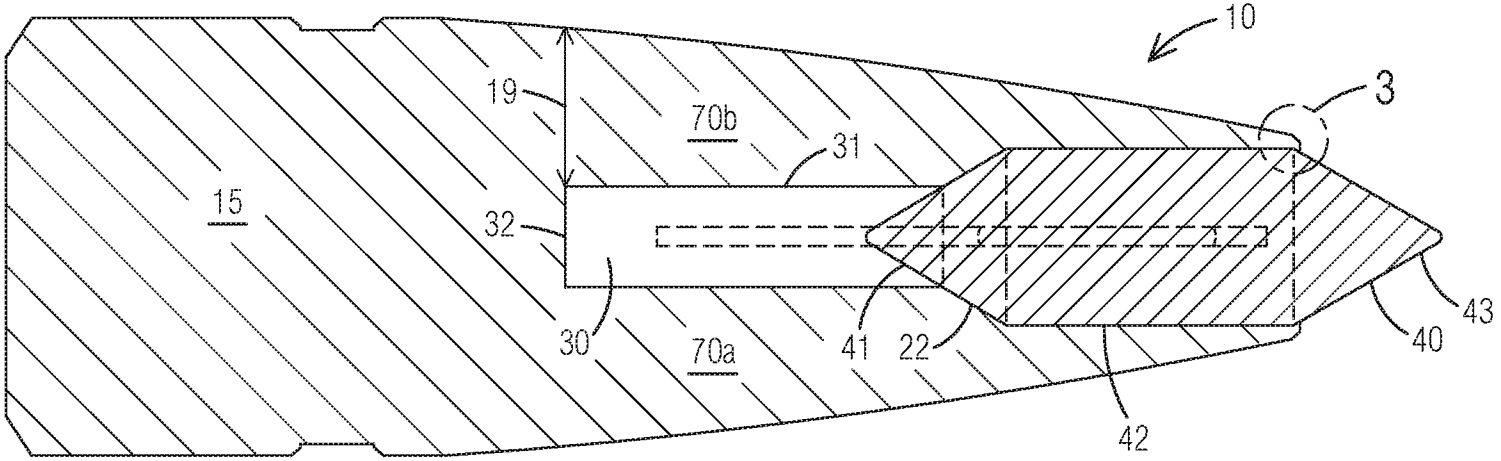
FIG. 2 is a side sectional view of the bullet of FIG. 1 according to an embodiment disclosed herein.

Turning now to FIG. 2, a side sectional view of the bullet 10 of FIG. 1 viewed along A-A, according to an embodiment disclosed herein is shown. The bullet 10 may include an insert 40 with an insert base 41, insert body 42, and an insert tip 43. The insert tip 43 and the insert base 41 may have the same shape or different shapes. The insert 40 may be manufactured of a dense material sufficient to penetrate any barrier. As a non-limiting example, the insert 40 may be manufactured out of compacted bronze powder using a metal sintering process. In other non-limiting examples, the insert 40 may be manufactured out of copper, sintered bronze, tungsten, tungsten carbide, plastics, polymers, a combination thereof, etc. It may be appreciated that the material and method of manufacturing the bullet 10 and the insert 40 is non-limiting and may be achieved using a plurality of materials and techniques. In an example embodiment, the body 11 is made of a solid metal, such as copper or any other suitable material known to the artisan.

In an embodiment, the insert 40 may be generally disposed within the primary cavity 20. As a non-limiting example, the insert base 41 may have a general shape to complement a shape of the support feature 22 of the primary cavity 20. In another non-limiting example, the insert body 42 may have a general shape to complement the primary contour 21 of the primary cavity 20. Yet, in some other non-limiting examples, the insert tip 43 may protrude from the mouth 14 (to the right as viewed in FIGS. 1 and 2). It may be appreciated that in some non-limiting embodiments at least one of the insert base 41, the insert body 42, and the insert tip 43 may be in contact with at least one of the primary contour 21 and the support feature 22.

In another embodiment, the insert 40 may be partially or completely disposed in at least one of the primary cavity 20 and the secondary cavity 30. In the non-limiting example of FIGS. 1 and 2, the insert body 42 is generally disposed and in contact with the primary contour 21 of the primary cavity 20. Further, the insert base 41 is partially disposed and in contact with the support feature 22 of the primary cavity 20 while simultaneously the insert base 41 is also partially disposed within the secondary cavity 30.

Figure 3:
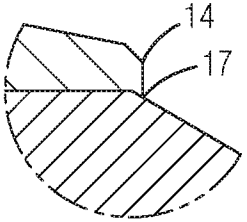
FIG. 3 is a side sectional detail view of the bullet of FIG. 2 according to an embodiment disclosed herein.

FIG. 3 is a detail, or exploded, view of the bullet with a crimp of FIG. 2 according to an embodiment disclosed herein. In an embodiment, the bullet 10 may include a crimp 17 protruding from the mouth 14 towards the center axis 16. In a non-limiting example, the crimp 17 may be achieved by deforming the mouth 14 inward towards the center axis 16. In another non-limiting example, the crimp 17 may be manufactured with the body 11 in an additive manufacturing machine or system that uses an additive manufacturing process such as, but not limited to, Fused Deposition Modeling (FDM), Stereolithography (SLA), Digital Light Processing (DLP), Selective Laser Sintering (SLS), Material Jetting (MJ), Drop on Demand (DOD), Binder Jetting, Direct Metal Laser Sintering (DMLS), Selective Laser Melting (SLM), Electron Beam Melting (EBM), or by any other additive manufacturing process.

Figure 4:
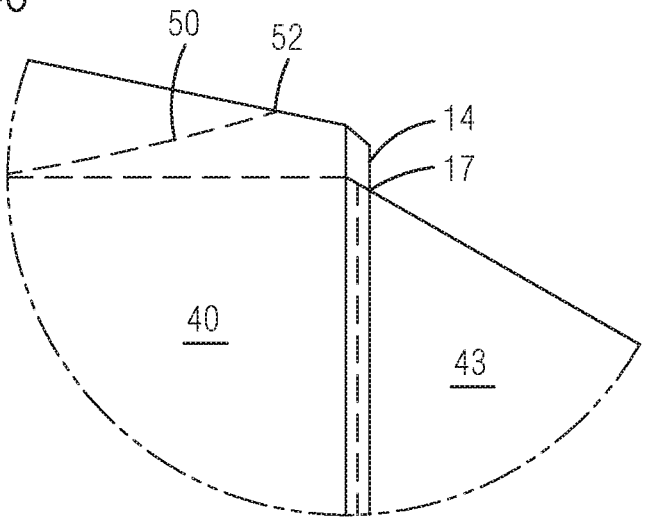
FIG. 4 is a side detail view of the bullet of FIG. 1 according to an embodiment disclosed herein.

The crimp 17 may secure the insert 40 to the body 11. In another embodiment, the mouth 14 may be deformed around the insert 40 at a point on at least one of the insert body 42 and the insert tip 43. As it may be appreciated by those skilled in the art, in the non-limiting exemplary embodiments discussed above, the crimp 17 may prevent the insert 40 from dislodging from the primary cavity 20 during the loading, handling, pressing, or chambering of the bullet 10 as shown in FIG. 4.

Returning back to FIG. 1, the bullet 10 may include at least one skive 50 formed along the outer surface 15 and generally aligned lengthwise with the center axis 16. In some embodiments, the skive 50 may be formed by the removal of material from the bullet 10 or the exclusion of it during manufacture. In an embodiment where the bullet 10 may include more than one skive 50, each skive 50 may or may not be equally spaced along a circumference 18 of the bullet 10 as shown in the non-limiting examples of FIGS. 6 through 8 and discussed in more detail below. The at least one skive 50 may include a base end 51, a distal end 52, a skive depth 53, and a skive contour 54.

Figure 5:
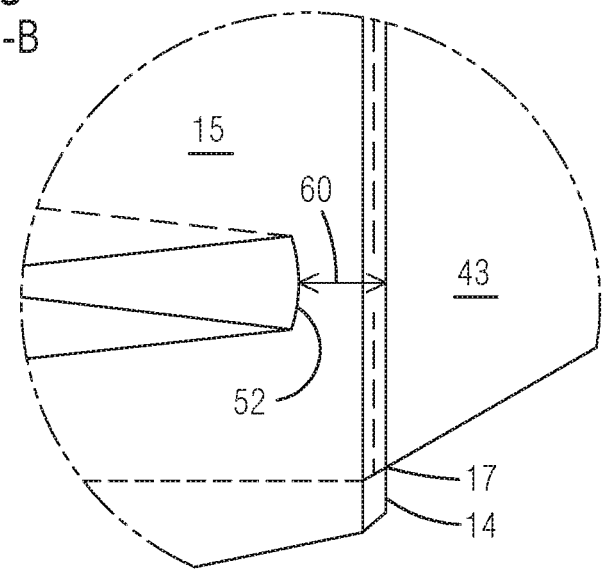
FIG. 5 is a side detail view of the bullet of FIG. 1 according to an embodiment disclosed herein.

The distal end 52 may be located on the outer surface 15 between the base end 51 and the mouth 14. In another embodiment, the distal end 52 may be separated from the mouth 14 by a width 60. A non-limiting example of the width 60 is illustrated in FIG. 5 which is taken along line B-B of FIG. 1. In yet another embodiment, the distal end 52 may or may not be coincident with the mouth 14. In the non-limiting example shown in FIG. 4 which is taken along line C-C of FIG. 1, the distal end 52 is not coincident with the mouth 14 thereby leaving a part of the outer surface 15 constituting a width 60 between the distal end 52 and the mouth 14. Similarly, in the non-limiting example shown in FIG. 5, a width 60 separates the distal end 52 and the mouth 14. In an alternate example embodiment, the distal end 52 is coincident with the mouth 14 such that the mouth 14 is not continuous in the circumferential direction. Instead, the mouth 14 is interrupted circumferentially by the skive 50. In an embodiment where the distal end 52 is coincident with the mouth 14, the crimp 17 may be used to help retain the insert 40 in the primary cavity 20.

The skive depth 53 of the skive 50 may be determined by a skive contour 54. In an embodiment, the skive contour 54 may be at least one of a semi-oval, a line, a circle, and a combination thereof. Yet, in another embodiment, the skive contour 54 may be an intricate profile with multiple non-limiting shapes. In embodiments where the skive contour 54 may have an oval-like or circular shape, the skive 50 may include a skive radius 56. The skive depth 53 may be determined by the skive radius 56. The skive radius 56 may be constant or it may be variable.

In an embodiment, the skive 50 is at least one of partially or completely coincident with at least one of the primary cavity 20 and the secondary cavity 30 wherein the skive 50 is communicated interiorly with at least one of the primary cavity 20 and the secondary cavity 30. In another embodiment, the skive 50 may not communicate with either the primary cavity 20 or the secondary cavity 30. In yet another embodiment, the skive 50 does not communicate with either the primary cavity 20 or the secondary cavity 30.

Between each pair of circumferentially adjacent skives 50 a respective petal 70*a*, 70*b*, 70*c* is formed. Each skive 50 is thereby bounded circumferentially by a respective pair of circumferentially adjacent skives 50, is bounded on a radially outward side 72*a*, 72*b*, 72*c* by the outer surface 15 of the body 11 and is bounded on a radially inward side 74*a*, 74*b*, 74*c* by the interior cavity 34. Hence, the skives 50, the petals 70*a*, 70*b*, 70*c*, and the interior cavity 34 all axially overlap each other at least partly relative to the center axis 16. Stated another way, the petals 70*a*, 70*b*, 70*c* include at least the main body material that is left between the skives 50. If the skives 50 extend parallel to the center axis, the petals 70*a*, 70*b*, 70*c* necessarily will also. If the skives 50 take another shape, the petals 70*a*, 70*b*, 70*c* necessarily will also. For example, if the skives 50 spiral about the center axis 16, the petals 70*a*, 70*b*, 70*c* will also. In other words, the skives 50 will have an extent along the center axis 16 and may or may not also includes an extent circumferentially around the center axis 16. The resulting petals 70*a*, 70*b*, 70*c* will do the same. In the embodiment shown in FIGS. 9 and 10, the skives 50 are circumferentially joined to each other at the mouth 14 because the skives 50 do not extend fully through the mouth 14. In other embodiments where the skives 50 do extend fully through the mouth 14, the skives will not be circumferentially attached to each other at the mouth 14. Alternately, or in addition, the width of the skive may change along the center axis 16. For example, the skive may widen along the center axis 16 or may narrow along the center axis 16. The skive may also have any combination of constant width, narrowing width, and/or widening width along the center axis 16.

The bullet 10 may be heat treated so that the proper deformation of the petals can occur without the petals snapping off as they deflect/mushroom radially outward.

Figure 6:
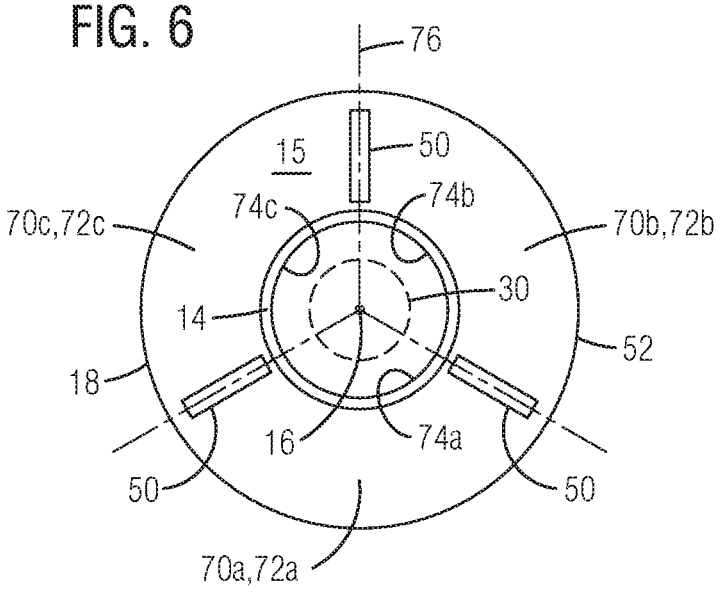
FIG. 6 is a front view of the bullet of FIG. 1 according to an embodiment disclosed herein.
Figure 7:
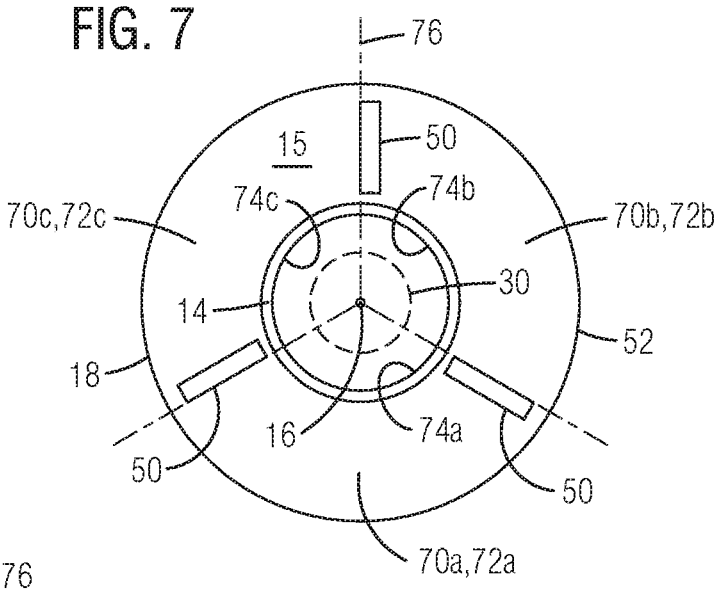
FIG. 7 is a front view of the bullet of FIG. 1 according to an embodiment disclosed herein.
Figure 8:
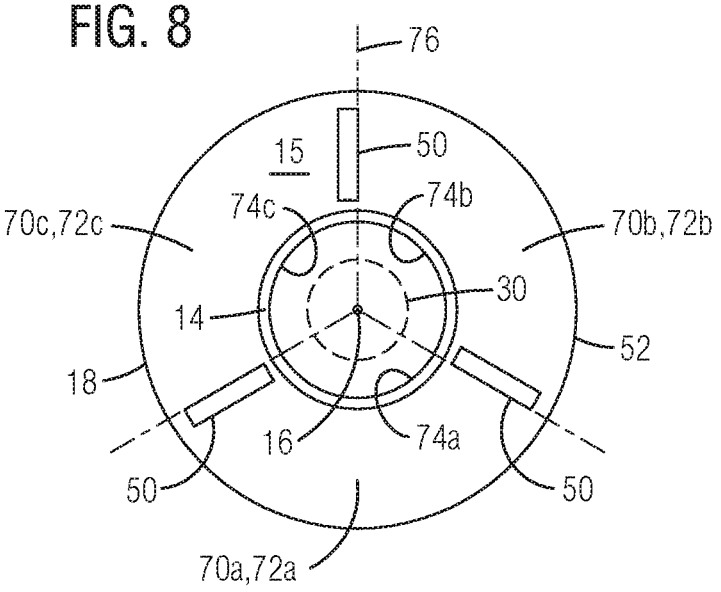
FIG. 8 is a front view of the bullet of FIG. 1 according to an embodiment disclosed herein.

Turning now to FIGS. 6 through 8, front views of the bullet 10 of FIG. 1 are shown according to non-limiting embodiments disclosed herein. In an embodiment, the at least one skive 50 may be centered with respect to the center axis 16 as illustrated by the non-limiting example of FIG. 6. In another embodiment, the at least one skive 50 may be offset in a clockwise direction with respect to the center axis 16 as illustrated by the non-limiting example of FIG. 7. In yet another embodiment, the at least one skive 50 may be centered offset in a counterclockwise direction as illustrated by the non-limiting example of FIG. 8. Offset skives offer the advantage of causing the bullet 10 to rotate in the soft target while and/or after the petals expand radially outward.

Being centered refers to the distal end 52 of the skive 50, when viewed from the distal end 13 looking toward the base 12 as shown in FIGS. 6-8, being circumferentially centered on a radian 76 that extends radially outward from the center axis 16 as seen in FIG. 6. Being offset refers to the distal end 52 being offset clockwise relative to the radian 76 as seen in FIG. 7 or offset counterclockwise relative to the radian 76 as seen in FIG. 8. In an embodiment where the skive 50 is straight and parallel to the center axis 16 as shown in FIGS. 6-8, if the distal end 52 of the skive 50 is centered, the entire skive 50 is centered. Likewise, if the distal end 52 is offset, the entire skive 50 is offset. In other embodiments, for example that of a spiral skive, or a skive that is straight but not parallel to the center axis 16, the position of the distal end 52 determines whether the skive 50 is considered centered of offset.

Figure 9:
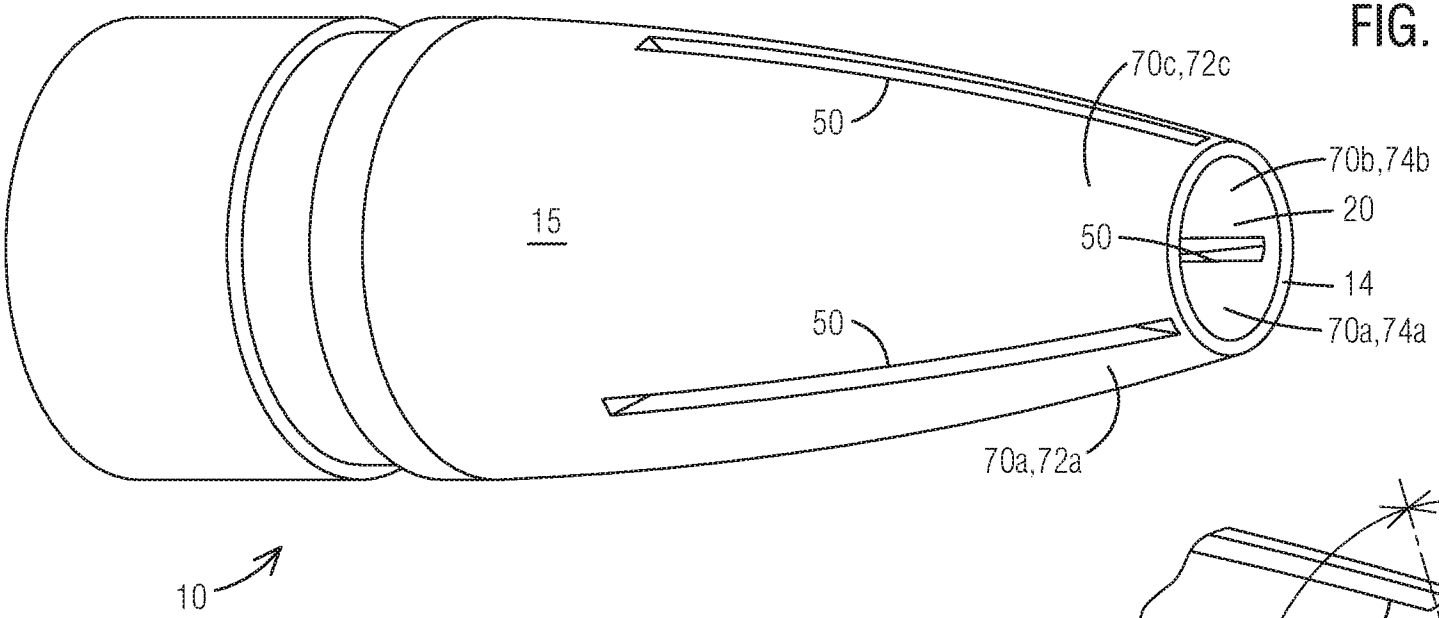
FIG. 9 is an isometric view of a bullet according to an embodiment disclosed herein.
Figure 10:
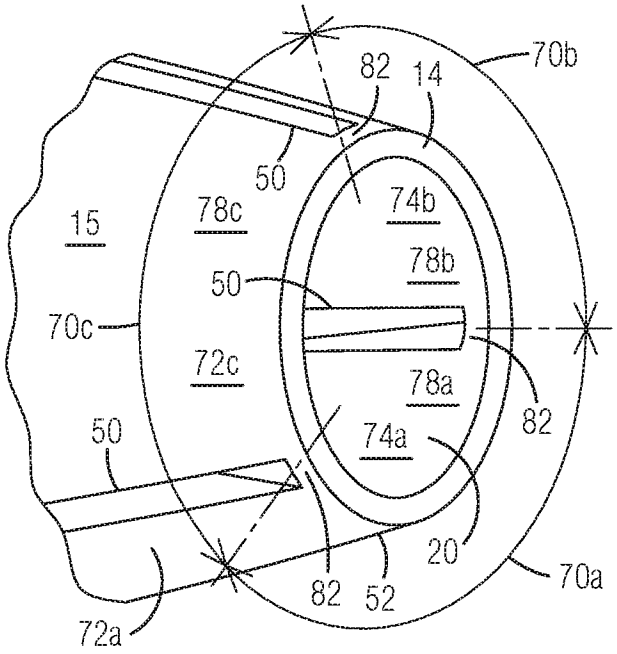
FIG. 10 is a detailed view of the bullet of FIG. 9 according to an embodiment disclosed herein.

FIGS. 9 and 10 are an isometric view and a detailed view, respectively, of a bullet 10 according to embodiments disclosed herein. In those non-limiting embodiments, the bullet 10 includes three equally spaced skives 50 interiorly communicating with the primary cavity 20.

As it may be appreciated by those skilled in the art, the secondary diameter 33 affects a wall thickness 19 of the bullet 10. In some non-limiting embodiments, the impact of the bullet 10 upon a target may deform the overall structure of the bullet 10. In an embodiment, the wall thickness 19 may determine a formation of petals, or how the bullet opens upon impact, as the bullet 10 expands and material of the bullet 10 yields along the at least one skive 50. As it may be further appreciated, in an other non-limiting embodiment, the difference between the secondary diameter 33 and the primary diameter 23 affects the dimensions of the support feature 22 and its engagement with the insert base 41 thereby affecting the force required of insert 40 to create a wedge action on impact to influence the expansion of bullet 10. In yet another embodiment, the floor 32 may be closer to the base 12 than the base end 51 is to the base 12. The relation between the floor 32 to base 12 distance and base end 51 to base 12 distance may determine a length of the generated petals when the bullet 10 expands and yields along the at least one skive 50.

In operation, the bullet 10 is fired toward a target. The target may be a hard target, a soft target, or a hard target in front of a soft target. As used herein, a hard target may an object behind which cover can be taken such as a barrier, for example, a vehicle door or a windshield. An example definition of soft target is ten percent (10%) ballistic gelatin (gel) calibrated to meet USA FBI protocol for calibrated ordnance gelatin. U.S. application Ser. No. 15/876,599 to Agazim, filed Jan. 22, 2018 is incorporated herein in its entirety and also describes operating principles shared with the invention disclosed herein.

In an example operation, the target is a hard target/barrier followed by a soft target. The insert 40 is structurally sufficient to retain its shape and provide radial support for the distal end 13 and the petals 70*a*, 70*b*, 70*c* thereof during impact with the barrier. The radial support counters the tendency of the distal end 13 and the petals 70*a*, 70*b*, 70*c* to buckle radially inward during impact with the barrier. Consequently, the distal end 13 with the insert 40 of the bullet 10 begin to pass through the barrier. In response to forces associated with the impact with the barrier, the insert 40 recesses (moves axially into) the primary cavity 20 (toward the base 12). The insert base 41 interacts with the support feature 22 which axially supports the insert 40. The axial support from the support feature 22 limits the amount of the recession into the primary cavity 20. A geometric interaction between the support feature 22 and the insert base 41 causes the support feature 22 to expand radially outward, thereby initiating expansion of the distal end 13. The support feature 22 is formed in the radially inward side 74*a*, 74*b*, 74*c* of the petals 70*a*, 70*b*, 70*c*. Accordingly, the radially outward expansion of the support feature 22 is necessarily a radially outward expansion of the petals 70*a*, 70*b*, 70*c* at least at an axial location of the support feature 22 in the petals 70*a*, 70*b*, 70*c*. In other words, the limited recession of the insert 40 into the primary cavity 20 is controlled by the support feature 22 by controlling how much the support feature 22 will yield to the insert 40. The yielding can be a radially outward yielding as is disclosed in this embodiment. Alternately, the yielding could be an axial yielding (not shown). The radial outward yielding, in turn, bulges the petals 70*a*, 70*b*, 70*c* radially outward. This bulging is an initial radial expansion step before a further radial expansion (i.e. a mushrooming) of the petals 70*a*, 70*b*, 70*c* discussed below.

Figure 11:
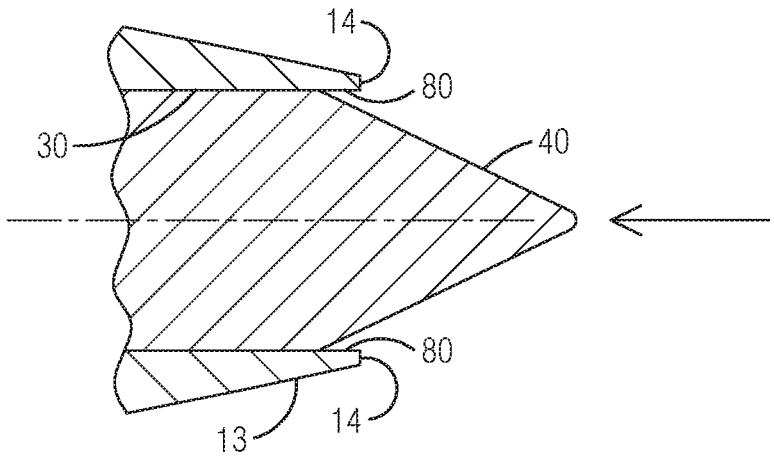
FIG. 11 is a side cross sectional view of pockets formed in the bullet according to an embodiment disclosed herein.

FIG. 11 shows an example embodiment of the insert 40 after the insert 40 has experienced the limited recession into the primary cavity 20. The limited recession of the insert 40 is configured to open a pocket 80 between the insert 40 and the mouth 14. The pocket 80 is configured to then capture soft target material and direct hydraulic forces caused by trapping the soft target material to the petals 70*a*, 70*b*, 70*c*. These hydraulic forces are configured to expand the petals 70*a*, 70*b*, 70*c* radially outward. The distal end 13 is configured so that the hydraulic forces are sufficient to sever any circumferential connection 82 between downstream ends 78*a*, 78*b*, 78*c* of circumferentially adjacent petals 70*a*, 70*b*, 70*c*. The petals 70*a*, 70*b*, 70*c* are configured so that, once any circumferential connections 82 are severed, the downstream ends 78*a*, 78*b*, 78*c* are configured to peel radially outward from the mouth 14 in response to the hydraulic forces. The radially outward peeling of the petals 70*a*, 70*b*, 70*c* is configured to happen in a controlled manner that permits a minimum amount of penetration into the soft target but does not permit the bullet to travel beyond a maximum desired penetration. In short, the insert 40 gets the petals 70*a*, 70*b*, 70*c* through the hard target/barrier intact, initiates an expansion process of the petals 70*a*, 70*b*, 70*c*, and creates pockets that make possible a completion of the expansion process. The completion of the expansion process of the petals 70*a*, 70*b*, 70*c* decelerates the bullet 10 to a stop before the bullet 10 exits the soft target.

In the embodiment of FIGS. 1-2, both the insert base 41 and the support feature 22 are tapered. The tapers are complimentary in that they both fit together flush and work together to permit the limited axial recession and associated radially outward expansion of the support feature 22. However, the artisan will understand that this geometric interaction is not the only geometric interaction that will support the desired goals of permitting the limited axial recession and associated radially outward expansion of the support feature 22.

Figure 12:
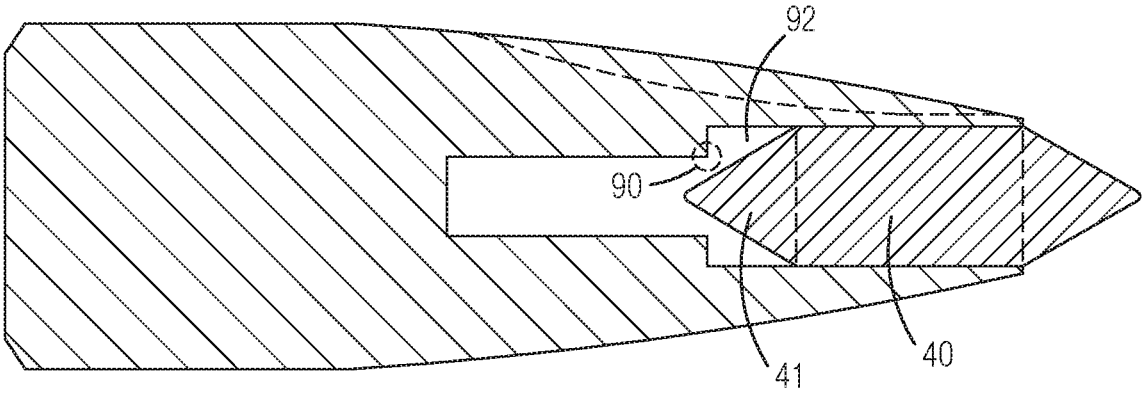
FIG. 12 is a side cross sectional view of the bullet according to an embodiment disclosed herein.

As shown in another example embodiment in FIG. 12, the support feature 90 need not be a ramp. Instead, the support feature 90 can be a corner (optionally rounded or with a chamfer) or any other feature that provides axial support and yields. Optionally, the support feature 90 can also yield radially to initiate the expansion process of the petals 70*a*, 70*b*, 70*c*. Here, the insert base 41 is ramped so the support feature 90 can provide axial support and can yield radially outward by riding the ramp of the insert base 41 as the insert 40 is recessed into the primary cavity 92.

Figure 13:
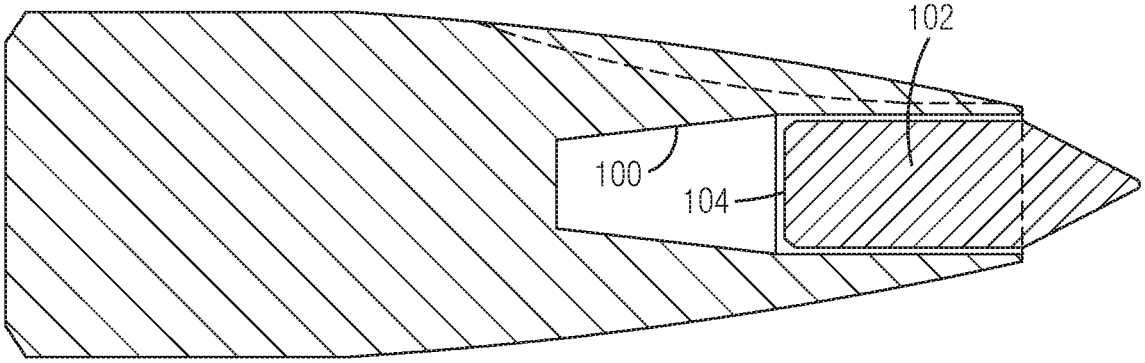
FIG. 13 is a side cross sectional view of the bullet according to an embodiment disclosed herein.

As shown in another example embodiment in FIG. 13, the opposite can be true such that the support feature 100 includes a ramp and the insert 102 has an insert base 104 that is a corner, (optionally rounded or with a chamfer). In this example embodiment, there is also no secondary cavity as defined above. Any combination of the above or equivalent known to the artisan that is capable of providing at least the required axial support by yielding, and optionally the radially outward deformation of the petals 70*a*, 70*b*, 70*c* is considered to be within the scope of this disclosure.

In light of the above it can be understood that the amount of axial recession of the insert and the amount of radial outward deformation can be tailored to expected circumstances and for various caliber rounds. For example, the support feature can be made stronger to provide more axial support by, for example, decreasing a diameter of the secondary cavity. This may be suitable for relatively harder hard targets and/or higher-energy rounds. Alternately, or in addition, the geometric interaction of the support feature and the insert base can be tuned. For example, the angles of the ramp of the support feature can be increased (e.g. the taper increased) so that axial resistance is greater, and vice versa. A non-limiting way of reducing support includes placing a gap of a predetermined magnitude between the support feature and the insert base. The length, width, and depth of the skives can also be adjusted in order to control an amount of resistance to the initial radially outward deformation of the support feature. Adjusting any and/or all of these characteristics also adjust an amount the pocket opens as the insert experiences the limited axial recession. This, in turn, adjusts how much soft tissue is captured and thereby adjusts the hydraulic forces associated therewith that initiate the opening of the petals. Adjusting the strength of the connection between circumferentially adjacent petals as well as the length, width, and depth of the skives will also adjust the characteristics associated with the opening process of the petals.

These characteristics, as well as those the artisan would appreciate from the disclosed geometry, are tailored to strike a balance. The balance is at least between a structural integrity sufficient for a round of given shape, size, and energy to penetrate a hard target; and a structural integrity that is insufficient for the round to penetrate a soft target behind the hard target. In the embodiment disclosed, this is done by using the impact with the hard target to change the geometry of the bullet from that having the structural integrity sufficient for the round to penetrate hard target into a geometry having a structural integrity that is insufficient for the round to penetrate a soft target behind the hard target. The change in geometry is accomplished by permitting the limited axial recession of the insert into the interior chamber which at least forms the pocket(s) and optionally initiates the radially outward deflection of the petals. The balance is tailored by controlling the amount of axial recession, the (optional) initial radially outward deformation and pocket formation resulting therefrom, and the remainder of the expansion process of the petals.

Each goal, e.g. penetrating the hard target, and not penetrating the soft target behind the hard target, can be further tailored. For example, a range of dimensions are available for petals of an example bullet that is known to be able to penetrate the hard target and retain enough energy to fully penetrate the soft target. In such an example bullet, the petals can be further tailored so they expand radially outward (open) in a manner that permits less penetration into the soft target, or alternately so they expand in a manner that permits more penetration into the soft target without exiting the soft target. The petals could also be configured to open such that the resistance they generate increases linearly, or nonlinearly, (e.g. exponentially). The latter case can increase the resistance the further the bullet travels into the soft target. This is because the resistance would initially be low, but would increase with further penetration. This increases chances of more penetration and also reduces the changes the bullet will pass fully through the soft target. The nature of the expansion can be controlled by adjusting the parameters disclosed above.

In an alternate embodiment, other structure such as connecting stitches could be placed in the skive between circumferentially adjacent petals. The stitches could be more prevalent toward the distal end of the skive/petals. The stitches would break under the hydraulic forces, but they would break starting at the distal end and working toward the base end 51 as the petals mushroom out. With more stitches at the distal end, a rate of opening of the distal end may be slow relative to a rate of opening of the base end 51. Stitches like this may not be a dispositive factor in the rate of expansion but could be used to tailor the expansion.

Figure 14:
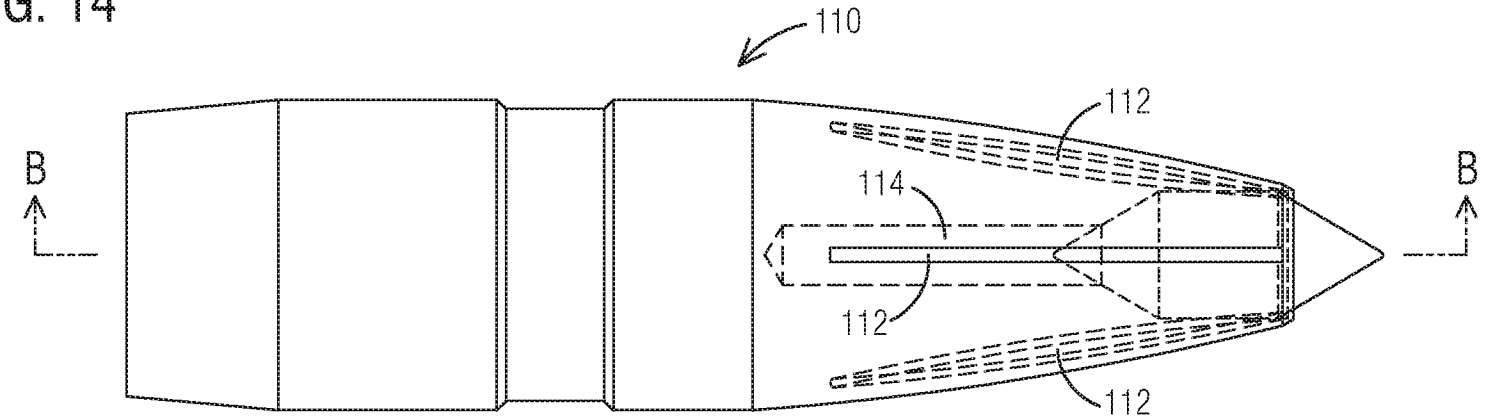
FIG. 14 is a side view of the bullet according to an embodiment disclosed herein.
Figure 15:
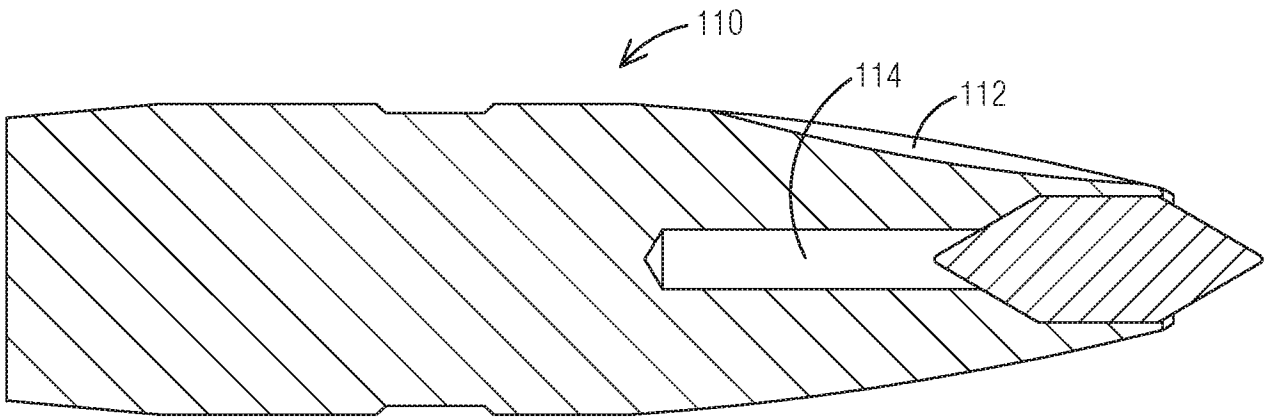
FIG. 15 is a side cross sectional view of the bullet of FIG. 14 along line B-B.

FIG. 14 shows an alternate example embodiment of the bullet 110 in which the skive 112 does not penetrate through and is thereby not in communication with the interior cavity 114. This configuration may be suitable for a bullet 110 having a relatively higher energy such that the hydraulic forces generated by the soft tissue and used to open the petals will be greater. For such a round, the skives need not provide as much of a stress riser (e.g. weak point that permits the petals to open faster). FIG. 15 shows a cross section of the alternate embodiment of FIG. 14 along line B-B, showing that the skive 112 is not in communication with the interior cavity 114.

Figure 16:
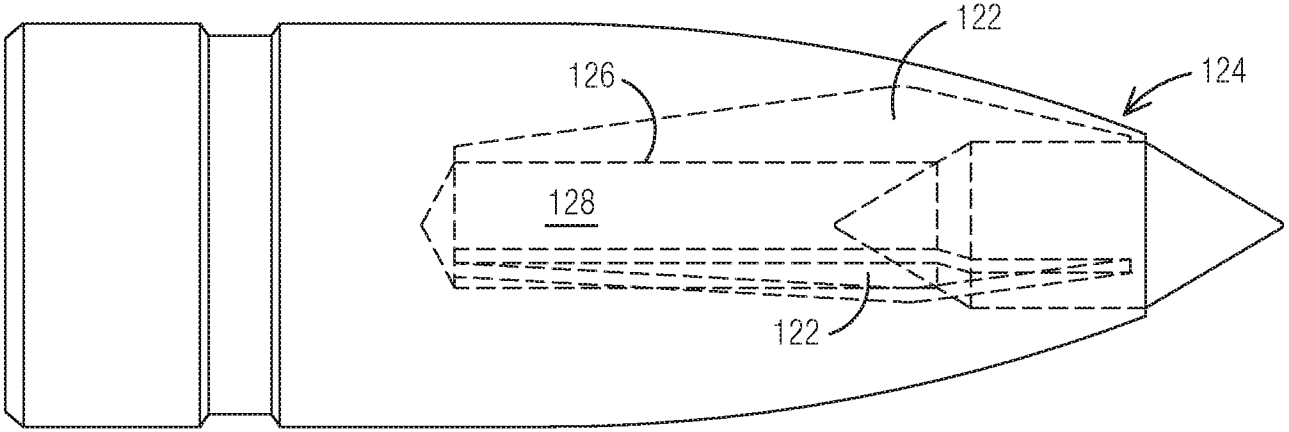
FIG. 16 is a side view of the bullet according to an embodiment disclosed herein.
Figure 17:
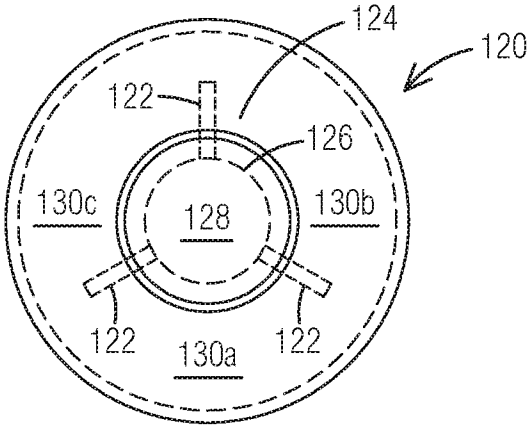
FIG. 17 is a front view of the bullet of FIG. 16 according to an embodiment disclosed herein.

FIGS. 16-17 show an alternate example embodiment of the bullet 120 in which the skives 122 are formed internal to the distal end 124. Specifically, the skives 122 are recessed radially outward from a radially outer surface 126 of the interior cavity 128. In the example embodiment shown, the skives 122 do not pass through the petals 130*a*, 130*b*, 130*c* to be in communication with the environment outside the bullet 120. However, in alternate example embodiments (not shown), the skives 122 do pass through the petals 130*a*, 130*b*, 130*c* (at least along a portion of a length of the skive) to be in communication with the environment outside the bullet 120. As with the example embodiments above, each feature of each embodiment can be configured as desired and added and removed as desired.

Unless otherwise defined, all terms (including technical and scientific terms) used herein have the same meaning as commonly understood by one of ordinary skill in the art to which embodiments belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another. As used herein the expression "at least one of A and B," will be understood to mean only A, only B, or both A and B.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

The invention claimed is:

1. A bullet, comprising:

a first material that forms a body comprising a base, a distal end comprising a mouth, and an interior cavity recessed into the body from the mouth;

an insert configured to be held in the interior cavity and to protrude from the mouth; and at least one skive formed in the distal end, comprising a long axis that extends from the base of the body to the distal end of the body, and axially overlapping the interior cavity relative to a center axis of the body, wherein the at least one skive does not reach the mouth;

wherein the interior cavity is configured to permit limited axial recession of the insert into the interior cavity when the insert impacts a hard target, and wherein the limited axial recession opens a pocket between the insert and the mouth.

2. The bullet of claim 1, wherein the limited axial recession initiates a radially outward expansion of the distal end.

3. The bullet of claim 1, wherein the interior cavity comprises a primary cavity in which the insert is disposed and defines a support feature configured to axially support the insert during the limited axial recession and configured to yield during the limited axial recession.

4. The bullet of claim 3, wherein yielding of the support feature during the limited axial recession initiates a radially outward expansion of the distal end.

5. The bullet of claim 3, wherein the support feature comprises a ramped shape configured to interact with a base of the insert such that the ramped shape expands radially outward in response to the limited axial recession of the base of the insert, thereby initiating a radially outward expansion of the distal end.

6. The bullet of claim 3, wherein a base of the insert comprises a ramped shape that interacts with the support feature to initiate the radially outward expansion in response to the limited axial recession of the base of the insert, thereby initiating a radially outward expansion of the distal end.

7. The bullet of claim 3, wherein the interior cavity further comprises a secondary cavity adjacent the support feature.

8. The bullet of claim 2, wherein the at least one skive comprises at least two skives, wherein circumferentially adjacent skives form a respective petal therebetween, and wherein the radially outward expansion of the distal end comprises a radially outward expansion of the respective petals axially behind the pocket.

9. The bullet of claim 1, wherein the at least one skive comprises a recess in an outer surface of the distal end.

10. The bullet of claim 9, wherein the at least one skive opens into the interior cavity.

11. The bullet of claim 9, wherein the at least one skive does not open into the interior cavity.

12. The bullet of claim 1, wherein the at least one skive comprises a recess in an outer surface of the interior cavity but does not open through an outer surface of the body.

13. The bullet of claim 1, wherein the at least one skive comprises a base end closer to the base of the body and a distal end closer to the distal end of the body, and wherein when viewed from the distal end of the body looking toward the base of the body, the distal end of the at least one skive is centered on a radian extending from the center axis of the body.

14. The bullet of claim 1, wherein the at least one skive comprises a base end closer to the base of the body and a distal end closer to the distal end of the body, and wherein when viewed from the distal end of the body looking toward the base of the body, the distal end of the at least one skive is not centered on a radian extending from the center axis of the body.

15. The bullet of claim 1, wherein the mouth is continuously circumferentially intact.

16. The bullet of claim 8, wherein the pocket is configured to trap soft target material and direct hydraulic forces caused by trapped soft target material to the respective petals, and wherein the respective petals are configured to peel radially outward from the mouth in response to the hydraulic forces.

17. The bullet of claim 1, wherein the insert comprises a sintered material and wherein the first material comprises solid copper.

18. A bullet, comprising:

a first material that forms a body comprising a base, a distal end comprising a mouth, and an interior cavity that is recessed into the body from the mouth and that defines a support feature;

an insert configured to be held in the interior cavity and to protrude from the mouth;

a plurality of skives: comprising respective long axes that extend from the base of the body to the distal end of the body; formed in the distal end of the body; axially overlapping the interior cavity relative to a center axis of the body; and forming a plurality of petals, each petal of the plurality of petals formed between respective circumferentially adjacent skives of the plurality of skives and between the interior cavity and an outer surface of the bullet, wherein the plurality of skives do not reach the mouth;

wherein the support feature is also formed in a radially inner surface of the plurality of petals and is configured to permit limited axial recession of the insert into the interior cavity when the insert impacts a hard target, and wherein the limited axial recession opens a pocket between the insert and the mouth and also initiates a radially outward expansion of the support feature and thereby the plurality of petals in which the support feature is formed.

19. The bullet of claim 18, wherein the support feature comprises a ramped shape.

20. The bullet of claim 18, wherein a base of the insert comprises a ramped shape that interacts with the support feature to initiate the radially outward expansion.

21. The bullet of claim 18, wherein the plurality of skives are formed in the outer surface of the bullet and open into the interior cavity.

22. The bullet of claim 18, wherein the plurality of skives are formed in the outer surface of the bullet and do not open into the interior cavity.

23. The bullet of claim 18, wherein the plurality of skives are formed in a radially outer surface of the interior cavity but do not open through an outer surface of the body.

24. The bullet of claim 18, wherein the pocket is configured to trap soft target material and direct hydraulic forces caused by trapped soft target material to the plurality of petals, and wherein the plurality of petals are configured to peel radially outward from the mouth in response to the hydraulic forces.

25. The bullet of claim 8, wherein the insert comprises a sintered material.

26. The bullet of claim 18, wherein skives of the plurality of skives each comprise a base end closer to the base of the body and a distal end closer to the distal end of the body, and wherein when viewed from the distal end of the body looking toward the base of the body, the distal ends of the skives are not centered on a radian extending from the center axis of the body.

27. A bullet, comprising:

a body comprising a base, a distal end comprising a mouth, and an interior cavity recessed into the body from the mouth;

an insert configured to be held in the interior cavity and to protrude from the mouth; and at least one skive formed in the distal end and axially overlapping the interior cavity relative to a center axis of the body, wherein the at least one skive does not reach the mouth;

wherein the interior cavity is configured to permit limited axial recession of the insert into the interior cavity when the insert impacts a hard target, and wherein the limited axial recession opens a pocket between the insert and the mouth; and wherein the at least one skive comprises a base end closer to the base of the body and a distal end closer to the distal end of the body, and wherein when viewed from the distal end of the body looking toward the base of the body, the distal end of the at least one skive is not centered on a radian extending from the center axis of the body.

28. A bullet, comprising:

a body comprising a base, a distal end comprising a mouth, and an interior cavity that is recessed into the body from the mouth and that defines a support feature;

an insert configured to be held in the interior cavity and to protrude from the mouth;

a plurality of skives: formed in the distal end; axially overlapping the interior cavity relative to a center axis of the body; and forming a plurality of petals, each petal of the plurality of petals formed between respective circumferentially adjacent skives of the plurality of skives and between the interior cavity and an outer surface of the bullet, wherein the plurality of skives do not reach the mouth;

wherein the support feature is also formed in a radially inner surface of the plurality of petals and is configured to permit limited axial recession of the insert into the interior cavity when the insert impacts a hard target; and wherein the limited axial recession opens a pocket between the insert and the mouth and also initiates a radially outward expansion of the support feature and thereby the plurality of petals in which the support feature is formed; and wherein skives of the plurality of skives each comprise a base end closer to the base of the body and a distal end closer to the distal end of the body, and wherein when viewed from the distal end of the body looking toward the base of the body, the distal ends of the skives are not centered on a radian extending from the center axis of the body.

* * * * *